United States Patent [19]

Watson

[11] Patent Number: 4,679,869

[45] Date of Patent: Jul. 14, 1987

[54] CABLE CONNECTOR HOLDER

[75] Inventor: David A. Watson, New Concord, Ohio

[73] Assignee: NCR Corporation, Dayton, Ohio

[21] Appl. No.: 830,424

[22] Filed: Feb. 18, 1986

[51] Int. Cl.[4] ..... H01R 13/658

[52] U.S. Cl. ..... 439/78; 439/610

[58] Field of Search ..... 339/14 R, 14 P, 143 R, 339/103 R, 103 M

[56] References Cited

U.S. PATENT DOCUMENTS

| | | | |
|---|---|---|---|
| 2,972,492 | 2/1961 | Mintz et al. | 285/117 |
| 3,958,851 | 5/1976 | Evans | 339/143 R |
| 4,130,334 | 12/1978 | Anderson | 339/103 M |
| 4,337,989 | 7/1982 | Asick et al. | 339/143 R |
| 4,381,129 | 4/1983 | Krenz | 339/14 R |
| 4,447,100 | 5/1984 | Dyce et al. | 339/14 R |
| 4,475,785 | 10/1984 | Muller et al. | 339/75 P |
| 4,491,381 | 1/1985 | Hamsher, Jr. et al. | 339/107 |
| 4,557,545 | 12/1985 | Ohtsuki et al. | 339/103 M |

*Primary Examiner*—John McQuade

*Attorney, Agent, or Firm*—Wilbert Hawk, Jr.; Albert L. Sessler, Jr.; Richard W. Lavin

[57] ABSTRACT

A holder for a shielded cable electrical connector used to connect the electrical connector to a printed circuit board includes a pair of opposed flange members for gripping the connector, a pair of opposed finger members extending from the tail portion of the holder for clamping the end of the cable providing a strain relief for the cable, a first surface portion extending from the surface of the holder in a direction to hold the connector within the flange members, a second surface portion of the holder which extends in a direction to engage a ground member located on the top surface of the printed circuit board upon mounting of the holder to the circuit board and a pair of tab portions for engaging the edge of the printed circuit board to lock the holder and the connector into engagement with a like connector mounted on the printed circuit board.

6 Claims, 5 Drawing Figures

CABLE CONNECTOR HOLDER

BACKGROUND OF THE INVENTION

The present invention is directed to electrical connectors of a type having multiple connecting wires and more particularly to a holder for such a connector which provides a ground connection to the cable containing the connecting wires for reducing radiated electrical emissions from the wires attached to the connector while also acting as a locking device from the connector to a printed circuit board.

In data processing systems which include a plurality of remote processing devices such as data terminals, communication between the remote processing devices and a central control processing unit takes place over a communication channel which normally takes the form of a multi-conductor shielded cable attached to each of the processing units. In order to meet federal standards that pertain to radiated electrical emissions from the cable, cable connectors have been developed which provide a ground connection to the cable, in addition to a strain relief for the cable. Examples of this type of connectors may be found in the U.S. Pat. Nos. 4,130,334, 4,491,381, 4,475,785, and 2,972,492. It has been found that these prior connectors when attached to their intended device are capable of having their ground connection interrupted due to movement of the electrical connector during operation of the processing device.

It is therefore, a principal object of this invention to provide a holder for a shielded electrical cable connector which provides a ground connection for the cable while mounting the connector in a locked position to a printed circuit board.

It is another object of this invention to provide a holder for a electrical connector which provides a strain relief for the cable associated with the connector.

It is a further object of this invention to provide a low-cost holder for an electrical cable connector which is constructed to facilitate easy mounting and removal of the electrical connector from a locking position with a printed circuit board.

SUMMARY OF INVENTION

These and other objects of the invention are fulfilled by providing a holder for an electrical connector which comprises a T-shaped support member having opposed U-shaped flange portions which engage and clamp the electrical connector housing to the support member. The support member includes a pair of finger end portions which are folded over the end of the cable and which engage a metallic sleeve located within the cable providing a strain relief for the cable and a ground connection for the sleeve. The support member further includes an abutment portion rising from the upper surface of the support member for holding the connector housing in a locked position on the support member and a pair of depending tab portions for engaging the side of a printed circuit board to lock the holder in a position against a ground plate located on the printed circuit board. The support member further includes a depending portion extending from the lower surface of the support member which engages the ground plate on the circuit board for grounding the support member and the metallic shield upon mounting the connector housing to the circuit board. The tab portions and the depending ground portion together with a mating electrical connector housing located on the printed circuit board provide a locking arrangement for locking the electrical connector into engagement with the circuit board.

BRIEF DESCRIPTION OF THE DRAWING

The foregoing and other objects, advantages and features of the invention will be described in greater detail, taken in connection with the drawings wherein.

DESCRIPTION OF THE PREFERRED EMBODIMENT

Figure 1:
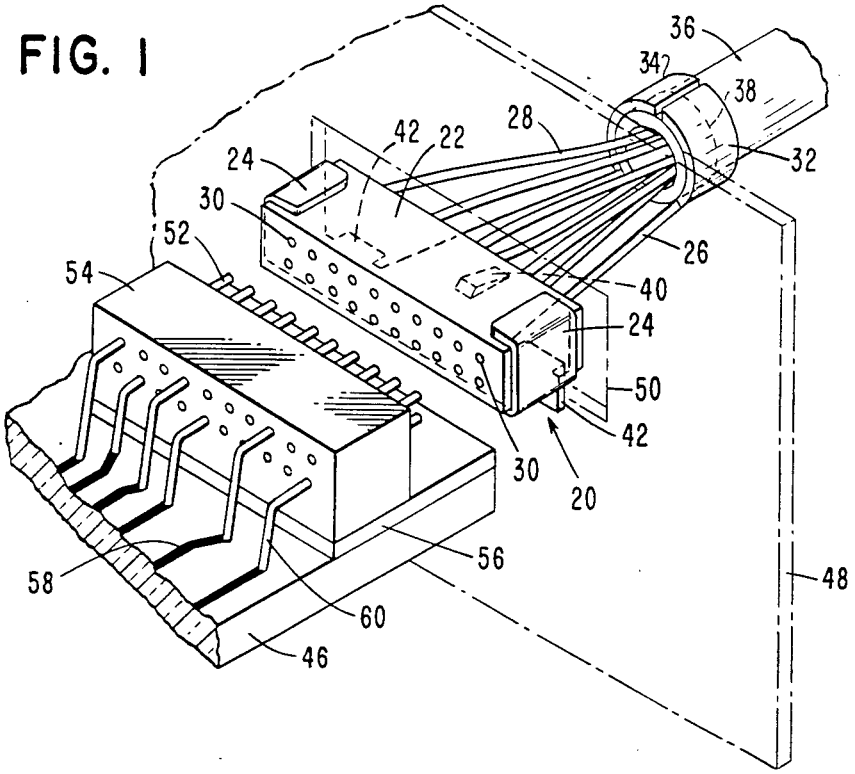
FIG. 1 is a perspective view of the electrical connector supported by the holder of the present invention prior to engagement with a printed circuit board.

Referring now to FIG. 1, there is shown a perspective view of an electrical connector assembly which includes the holder of the present invention prior to engagement to a printed circuit board. The connector assembly generally indicated by the numeral 20 includes a multi-wire connector housing 22 mounted within a pair of opposed U-shaped flange portions 24 of a T-shaped holder 26. The holder 26 supports a plurality of wires 28 extending from the housing 22. Each wire is connected to a female receptacle 30 mounted within the housing 22 in a manner that is well known in the art. The holder 26 further includes an end clamping portion 32 which comprises a pair of flexible finger portions 34 (FIG. 3) which are wrapped around a cable 36 holding the wires 28. The cable 36 includes a metallic sleeve member 38, which engages the holder 26 to ground the sleeve member, thus shielding the wires 28 thereby reducing the emissions of electrical energy from the wires.

Figure 3:
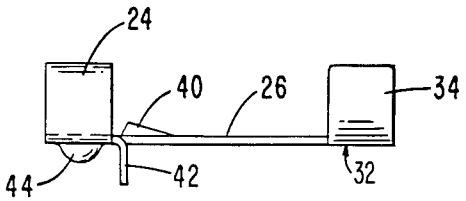
FIG. 3 is a side plan view of the electrical connector holder of the present invention.
Figure 4:
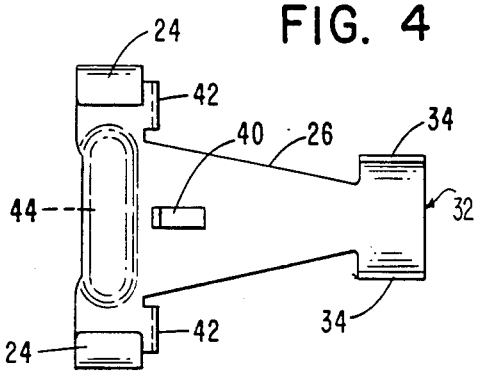
FIG. 4 is a top plan view of the electrical connector holder of the present invention.
Figure 5:
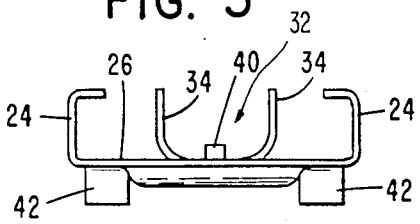
FIG. 5 is a front view of the electrical connector holder of the present invention.

As best shown in FIGS. 3–5 inclusive, the holder 26 further includes an abutment portion 40 rising from the upper surface of the holder 26. As will be described more fully hereinafter, this abutment portion 40 locks the connector housing 22 into a mounted position on the holder 26. The holder 26 includes a pair of bent-over depending tab members 42 and a depending grounding portion or projection 44 extending from the lower surface of the holder. As will be described more fully hereinafter, both the tab numbers 42 and the grounding portion 44 cooperate to lock the connector assembly 20 into engagement with the printed circuit board.

In assembling the electrical connector assembly 20, the connector housing 22 is positioned within the flange portions 24 of the holder 26 and against the abutment portion 40 after which the flange portions 24 are pressed firmly against the housing thereby locking the housing within the holder. The end of the cable 36 is then prepared to have the metallic sleeve member 38 exposed by folding the end of the sleeve member back over the end of the cable, after which the ends of the cable and the sleeve member are positioned within the finger portions 34 (FIGS. 3–5 inclusive) of the holder 26. The finger portions 34 are then folded over the ends of the cable 32 and the sleeve member 38 providing a strain relief for the cable and a ground connection to the sleeve 38.

Figure 2:
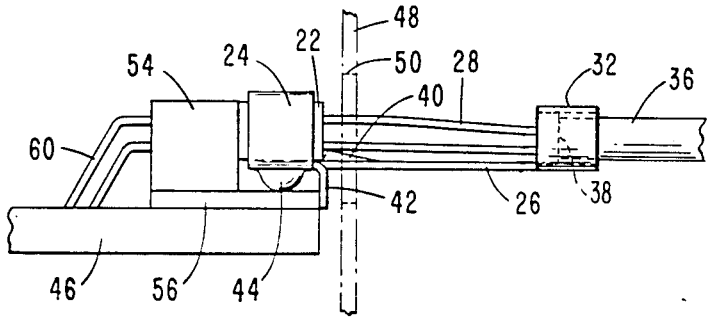
FIG. 2 is a side view of the electrical connector after engagement with a printed circuit board.

In mounting the electrical connector assembly 20 to the circuit board 46 (FIGS. 1 and 2) located adjacent a wall 48 of a cabinet (not shown), the assembly 20 is positioned within a cut-out portion 50 of the cabinet wall 48 and moved in a slightly downward direction to a position engaging a plurality of connecting pins 52 extending from a mating connector housing 54. The housing 54 is mounted on a grounding plate 56 secured to the top of the circuit board 46. Each of the connecting pins 52 will be positioned slightly below a corresponding receptacle 30 in the housing 22. This arrangement requires that the housing member 26 be canted in a slightly downward direction to allow the tops of the connecting pins 52 to be positioned within the entrances of the receptacles 30. Movement of the electrical connector assembly 20 into engagement with the connecting pins 52 forces the assembly 20 in a downward direction and the grounding portion 44 of the holder 26 into engagement with the grounding plate 56, locking the connector assembly 20 with the grounding plate 56. This movement also locates the depending tab members 42 between the edge of the circuit board and the wall 48 (FIG. 2), thus locking the connector assembly 20 into an engaging position with the housing 54. The connecting pins 52 are connected to the conductors 58 (FIG. 1) in the circuit board by means of connecting wires 60.

It will be seen from this construction that the holder 26 provides a grounding connection to the sleeve member 38 for reducing the electrical emissions of the wires 28 in the cable 36 and further provides a strain relief to the cable when connected to the circuit board 46. The holder 26 also locks the electrical connector to the circuit board in a manner which prevents the accidental interruption of the electrical and ground connections due to the inadvertent movement of the connector.

While the invention has been described in its preferred embodiment, it is to be understood that the words that have been used are words of description rather than limitation, and that changes in construction may be made within the purview of the claims without departing from the true scope and spirit of the invention in its broader aspects.

What is claimed is:

1. In combination with an electrical connector having mating first and second housing members in which the first housing member is mounted on a supporting surface and includes a plurality of pin members and a second housing member which includes corresponding apertures for connection to the ends of a plurality of wires extending from a cable having a metallic sleeve surrounding the wires within the cable, a support member for the second housing member comprising;

an elongated body portion having opposed flange portions located at one end of the body portion for receiving and holding the housing member in a mounted position on the body portion;

a stop portion on the body portion for engaging one end of the housing member to hold the housing member in said mounted position;

means extending from the body portion for engaging a ground member located on the supporting surface upon mounting of the second housing member to the first housing member;

and a pair of opposed finger portions located at one end of the body portion opposite the flange portion end and extending outwardly from said body portion to engage the cable and the metallic sleeve, said finger portions being squeezed around the cable and the sleeve to provide a strain relief on the cable and to ground the metallic sleeve upon mounting of the second housing member to the first housing member.

2. The support member of claim 1 which further includes a pair of depending tab portions mounted along the rear edge of the flange portions for engaging the supporting surface to hold the engaging means against the ground member upon mounting of the second housing member to the first housing member.

3. The support member of claim 2 in which each of the opposed flange portions terminate in a U-shaped end portion for gripping the edges of the second housing member.

4. The support member of claim 3 in which said engaging means comprises a projection portion of the body portion extending in a downward direction from the lower surface of the body portion for engaging the ground member on the supporting surface upon the mounting of the second housing member on the first housing member.

5. A holder for an electrical connector having a first housing member for use with a multi-wire cable including a shield member located within the cable and surrounding the wires and adapted to mate with a second generally like connector housing member having connecting pins engaging apertures in said first housing member, said second housing member being mounted on a printed circuit board comprising;

a T-shaped support member having an elongated body portion and opposed flange portions located at the T-shaped end for receiving and gripping the first housing member in a mounted position on the T-shaped support member, said body portion including;

a stop portion rising from the top surface of the body portion intermediate the ends of the opposed flange portions for engaging one end of the first housing member to hold the housing member in said mounted position;

a depending projection portion extending downwardly from the lower surface of the body portion and in a direction transversed to the longitudinal axis of the body portion for engaging a ground member mounted on the printed circuit board upon the mating of the first said housing member to the second housing member on the printed circuit board;

and a tail portion having opposed outwardly extending finger portions for engaging the cable and the shield member, said finger portions being wrapped around the cable and shield member to provide a strain relief for the cable and to ground the shield member upon the mating of the second housing member to the first housing member on the printed circuit board.

6. The support member of claim 5 which further includes a pair of tab portions extending in a downward direction from the rear edge of the flange portions for engaging the edge portion of the printed circuit board whereby the projection portion of the body portion is held against the ground member upon the mating of the first housing member to the second housing member.

* * * * *